US006570306B2

(12) United States Patent
Henrici et al.

(10) Patent No.: US 6,570,306 B2
(45) Date of Patent: May 27, 2003

(54) LAMP-SOCKET CONTACT

(75) Inventors: Dieter Henrici, Arnsberg (DE); Manuel Rodrigues, Wickede/Ruhr (DE)

(73) Assignee: BJB GmbH & Co. KG, Arnsberg (DE)

( * ) Notice: Subject to any disclaimer, the term of this patent is extended or adjusted under 35 U.S.C. 154(b) by 110 days.

(21) Appl. No.: 09/738,280

(22) Filed: Dec. 15, 2000

(65) Prior Publication Data

US 2001/0024079 A1 Sep. 27, 2001

(30) Foreign Application Priority Data

Dec. 16, 1999 (DE) ..... 199 60 627

(51) Int. Cl.[7] ..... H01J 5/48

(52) U.S. Cl. ..... 313/318.01; 439/437; 439/441; 361/360

(58) Field of Search ..... 313/318.01; 439/437, 439/438, 439, 440, 441; 361/360, 395

(56) References Cited

U.S. PATENT DOCUMENTS 4,596,433 A 6/1986 Oesterheld ..... 339/112 R
4,740,175 A * 4/1988 Stumpff et al. ..... 439/441
5,207,587 A * 5/1993 Hamill et al. ..... 439/76
6,039,597 A * 3/2000 Getselis et al. ..... 439/439

FOREIGN PATENT DOCUMENTS

| | | |
|---|---|---|
| DE | 2517465 | 10/1976 |
| EP | 0865105 | 9/1998 |
| EP | 0908966 | 4/1999 |

* cited by examiner

*Primary Examiner*—Don Wong
*Assistant Examiner*—Jimmy T. Vu
(74) *Attorney, Agent, or Firm*—Herbert Dubno; Andrew Wilford

(57) ABSTRACT

A lamp holder has a socket housing forming a seat centered on an axis, and a contact fitted to the seat and formed unitarily with a pair of opposite generally axially extending sides flanking the axis. A front finger extending generally axially from one of the sides has a pair of opposite edges and therebetween a face directed radially toward the axis and pressing the lamp contact pin transversely of the axis against the other side. A back finger extending from the other side offset laterally from the front finger has an outer edge juxtaposed with the one side. The conductive core is pinched between the outer edge and the one side laterally adjacent the front finger and bears laterally against one of the edges of the front finger.

10 Claims, 3 Drawing Sheets

LAMP-SOCKET CONTACT

FIELD OF THE INVENTION

The present invention relates to a lamp-socket contact. More particularly this invention concerns the conductive element that is fitted in a seat of a lamp holder or socket and that makes the electrical connection between the contact pins of a lamp fitted to the holder and a supply or connecting wire.

BACKGROUND OF THE INVENTION

As described in U.S. Pat. No. 4,596,433 of Oesterheld, a standard lamp-socket contact is formed of a flat blank of sheet bronze or copper-coated steel that is bent into a complex shape having two opposite longitudinally extending and parallel but transversely spaced sides joined by a bight. Each side is formed at a front end with a forwardly extending pin-gripping finger between which the respective contact pin of a normally fluorescent bulb is inserted. At its rear end one side has another inwardly projecting but oppositely angled finger that presses a stripped wire end against the other side of the contact. The rear end is formed with a bent-in tab having a hole through which the wire is inserted. The fingers that grip the lamp pin are offset longitudinally from the finger that grips the feed wire. This item is mass produced and is provided with other formations that ensure that once it is pushed down into a seat in an elastomeric housing it will remain in place.

Such a contact is of relatively complex construction, in particular with respect to the complex bending job needed to make it from a flat blank, so that it is not cheap to manufacture. Furthermore it is relatively long as the wire inserted in the rear of the contact must be kept out of the way of the pin inserted into its front.

OBJECTS OF THE INVENTION

It is therefore an object of the present invention to provide an improved lamp-socket contact.

Another object is the provision of such an improved lamp-socket contact which overcomes the above-given disadvantages, that is which is of simple and inexpensive construction, and that is longitudinally particularly short.

SUMMARY OF THE INVENTION

A lamp holder has according to the invention a socket housing forming a seat centered on an axis, and a contact fitted to the seat and formed unitarily with a pair of opposite generally axially extending sides flanking the axis. A front finger extending generally axially from one of the sides has a pair of opposite edges and therebetween a face directed radially toward the axis and pressing the lamp contact pin transversely of the axis against the other side. A back finger extending from the to other side offset laterally from the front finger has an outer edge juxtaposed with the one side. The conductive core is pinched between the outer edge and the one side laterally adjacent the front finger and bears laterally against one of the edges of the front finger.

Thus with this arrangement the conductive core is out of axial line with the pin so that the core and pin can axially overlap each other, that is the front end of the conductive core is axially forward of the rear end of the lamp pin. As a result the lamp holder can be made very short. This shortness further increases the proximity of the conductive wire core and the lamp pin, ensuring low-loss flow of current between them. Furthermore the contact itself is of fairly simple construction, easily formed by stamping a blank and folding it into a three-sided shape that is snapped into the seat in the socket housing.

The contact further is formed unitarily with a bight extending between the sides offset from the axis. The conductive core is captured between the bight and the one side edge of the front finger. In addition the contact has another back finger extending from the other side offset laterally from the front finger and having an outer edge juxtaposed with the one side. The back fingers laterally flanking the front finger. A conductive core of another wire is pinched between the outer edge of the other back finger and the one side and bears laterally against the other of the edges of the front finger. Thus when two conductors are fitted to the holder, one of them is captured on all four sides by the contact and the other on three sides, once again ensuring excellent electrical contact.

The back in accordance with the invention tabs are laterally adjacent and parallel to each other. Furthermore the socket housing is formed with a hole parallel to the axis and of a diameter sufficient to pass only the conductive core of the wire. The contact is further formed with a second front finger extending from the other side and having a face directly confronting the face of the first-mentioned front finger and holding the lamp pin therewith. The edges of the front finger extend parallel to each other in planes spacedly flanking the axis.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
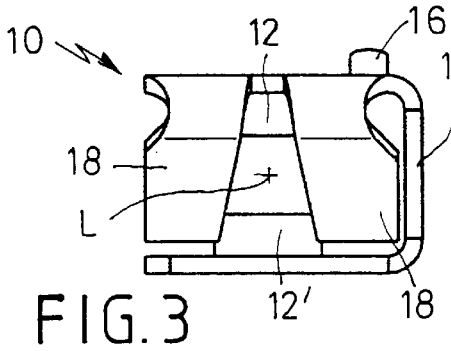
FIGS. 3 and 4 re end and side views taken n the direction of respective arrows III and IV of FIG. 2.
Figure 2:
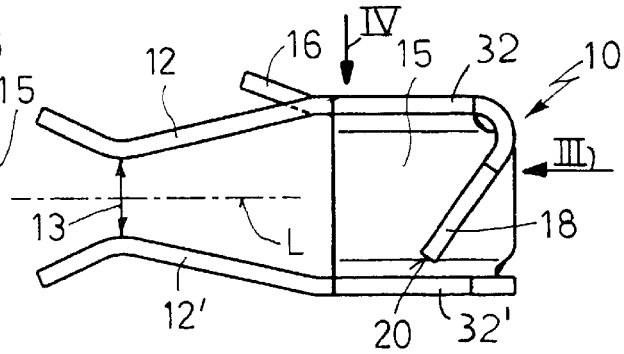
FIG. 2 is a side view taken in the direction of arrow II of FIG. 1.
Figure 4:
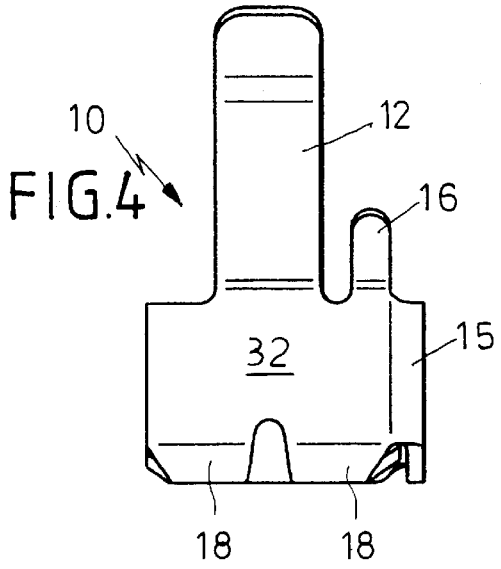
Figure 1:
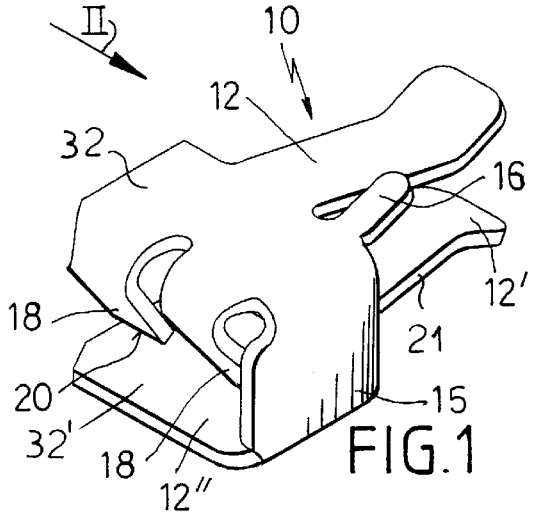
FIG. 1 is a perspective view of the contact according to the invention.
Figure 5:
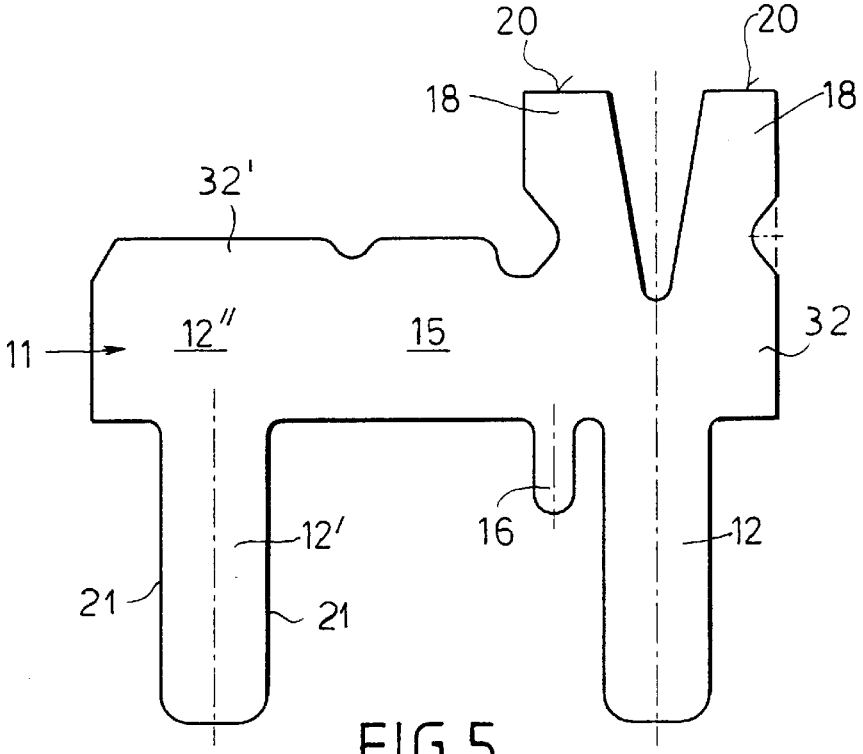
FIG. 5 is a plan view of a blank from which the contact of this invention is made.

As seen in FIGS. 1 through 5 a lamp-socket contact 10 according to the invention is formed from a planar metal blank 11 having a pair of opposite sides 32 and 31'. The side 32 forms a forwardly extending pin-holding finger 12, a pair of forwardly bent contact-engaging fingers 18 having edges 20, and a forwardly projecting retaining tab or barb 16. The other side 32' forms another forwardly extending pin-holding finger 12' and has an inner surface 12" that confronts and cooperates with the edges 20. A bight 15 connects the two sides 32 and 32' when the blank 11 is folded to form three sides of a square-section tube centered on a longitudinal axis L, the region opposite the bight 15 being laterally open.

Figure 6:
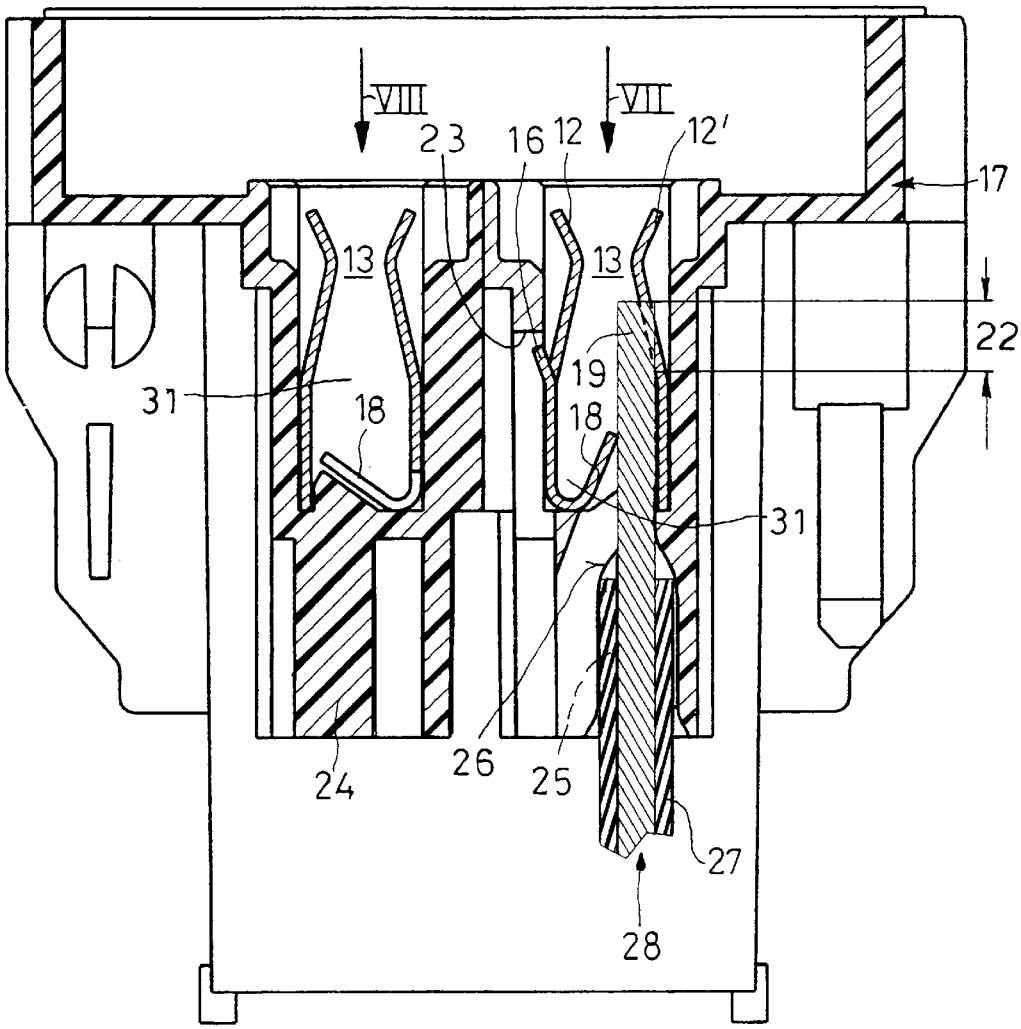
FIG. 6 is a longitudinal section through a lamp holder with the contact according to the invention connected to a feed wire.
Figure 8:
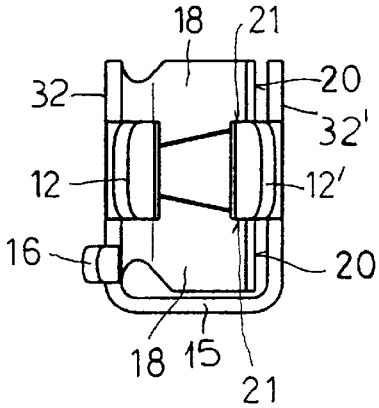
FIGS. 7 and 8 are front end views of the contacts in the direction of respective arrows VII and VIII of FIG. 6.
Figure 7:
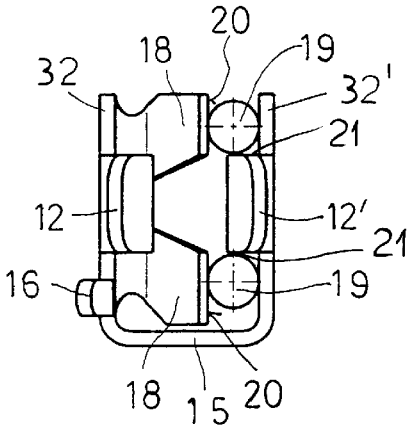
Figure 9:
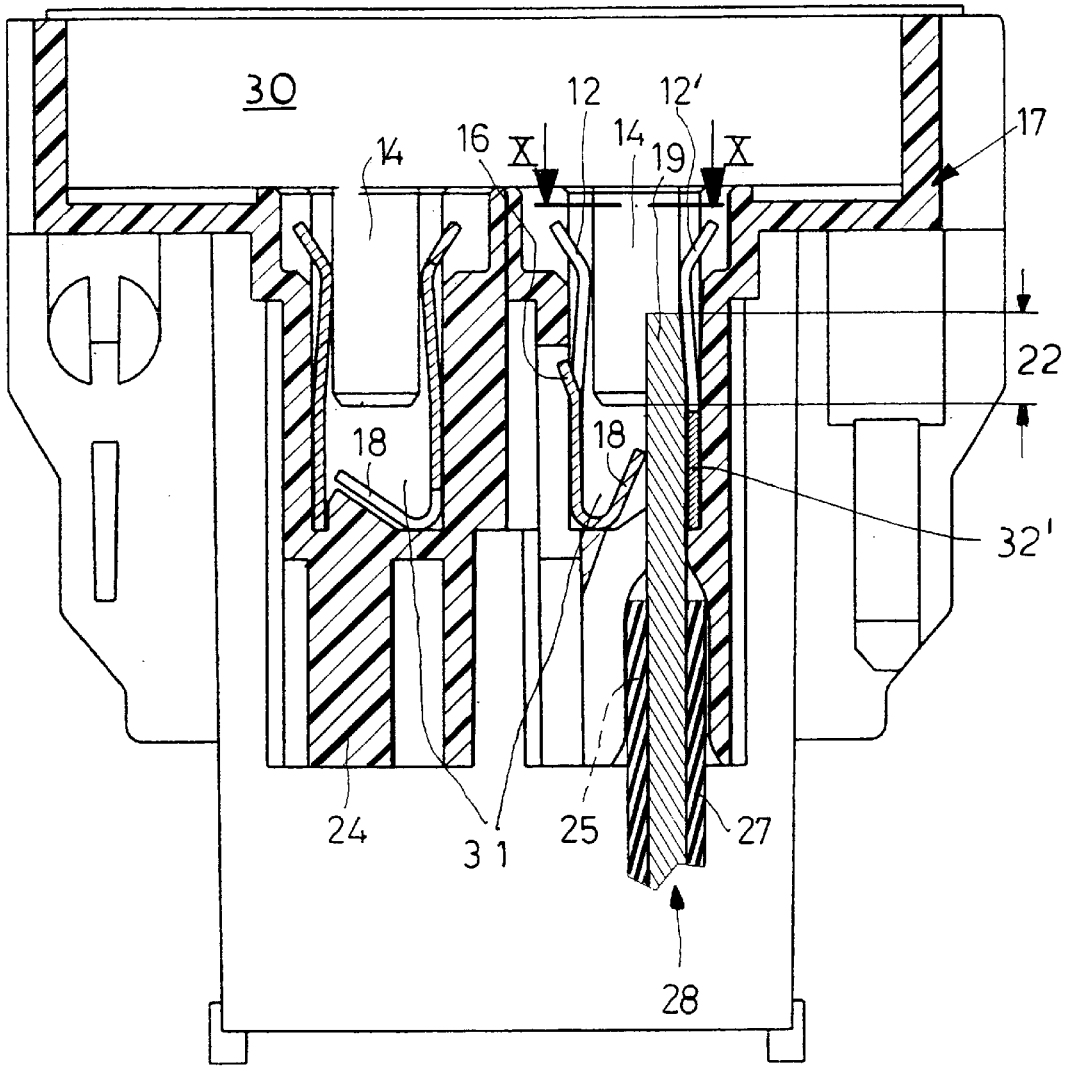
FIG. 9 is a view like FIG. 6 but with the a lamp as well as a feed wire fitted to the lamp holder.
Figure 10:
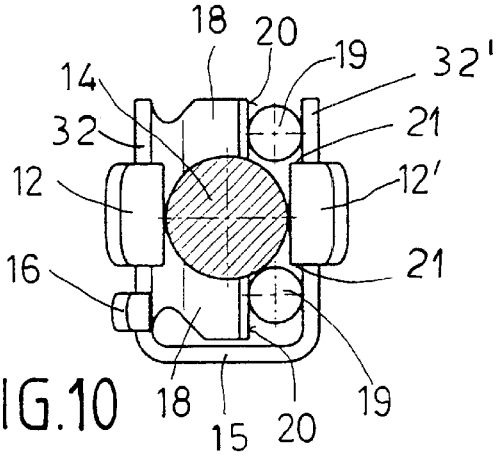
FIG. 10 is a section along line X—X of FIG. 9.

The entire contact 10 is fitted as shown in FIGS. 6 and 9 to a respective square-section seat or cavity 31 of a dielectric (e.g. porcelain or plastic) lamp holder or socket 17 having a forwardly open seat 29 for a bulb 30 having contact pins 14. The two front fingers 12 and 12' of each contact 10 converge centrally at 13 so as to grip the respective pin 14 of the lamp 30 inserted the seat 29 of the socket 17. The barbs 16 engage under rearwardly facing edges 23 of the seats 31 of the socket 17 to retain the elements 10 in the seats 31.

The socket 17 has a rear wall 24 formed at each seat somewhat offset from the respective axes L with a pair of rearwardly open holes 25 having restricted front ends 26 and each adapted to receive a wire 28 comprised of a conductive core 19 and insulation 27. Each conductive core 10 is gripped between the edge 20 of the respective finger 18 and the surface 12" with the restricted end or shoulder 26 engaging the end of the insulation 27 and limiting how far the wire 28 can be poked into the hole 25. The wire core 19 is laterally guided on an inner side by a side edge 21 of the finger 12' and on an outer side either by the wall of the socket 31 or by the bight 15. The edges 21 therefore keep the wire 19 out of the way of the pin 14 received in the same socket hole 31 so that the wire 19 can longitudinally overlap the pin 14 at a region 22.

Instead of two back fingers 18 mounted on the side 32, one such finger could be mounted on the side 32 and the other on the side 32' for diagonal opposite positioning of two conductors 19.

We claim:

1. In combination with a wire having a conductive core and a lamp having a contact pin, a lamp holder comprising:

a socket housing forming a seat centered on an axis; and a contact fitted to the seat and formed unitarily with a pair of opposite generally axially extending sides flanking the axis, a front finger extending generally axially from one of the sides and having a pair of opposite edges and therebetween a face directed radially toward the axis and pressing transversely of the axis against the lamp contact pin, and a back finger extending from the other side offset transversely of the axis from the front finger and having an outer edge juxtaposed with the one side, the conductive core being pinched between the back-finger outer edge and the one side laterally adjacent the front finger and bearing laterally against one of the edges of the front finger.

2. The lamp holder defined in claim 1 wherein the contact further is formed unitarily with a bight extending between the sides offset from the axis, the conductive core being captured between the bight and the one side edge of the front finger.

3. The lamp holder defined in claim 2 wherein the contact is further unitarily formed with another back finger extending from the other side offset laterally from the front finger and having an outer edge juxtaposed with the one side, the back fingers laterally flanking the front finger, a conductive core of another wire being pinched between the outer edge of the other back finger and the one side and bearing laterally against the other of the edges of the front finger.

4. The lamp holder defined in claim 3 wherein the back tabs are laterally adjacent and parallel to each other.

5. The lamp holder defined in claim 1 wherein the socket housing is formed with a hole parallel to the axis and of a diameter sufficient to pass only the conductive core of the wire.

6. The lamp holder defined in claim 1 wherein the contact is further formed with a second front finger extending from the other side and having a face directly confronting the face of the first-mentioned front finger and holding the lamp pin therewith.

7. The lamp holder defined in claim 1 wherein the edges of the front finger extend parallel to each other in planes spacedly flanking the axis.

8. The lamp holder defined in claim 1 wherein the pin and core axially overlap each other.

9. In combination with a wire having a conductive core and a lamp having a contact pin, a lamp holder comprising:

a socket housing forming a seat centered on an axis; and a contact fitted to the seat and formed unitarily with a pair of opposite generally axially extending sides flanking the axis, a front finger extending generally axially from one of the sides and having a pair of opposite edges and therebetween a face directed radially toward the axis and pressing the lamp contact pin transversely of the axis against the other side, a back finger extending from the other side offset laterally from the front finger and having an outer edge juxtaposed with the one side, the conductive core being pinched between the outer edge and the one side laterally adjacent the front finger and bearing laterally against one of the edges of the front finger, a bight extending between the sides offset from the axis, the conductive core being captured between the bight and the one side edge of the front finger; and another back finger extending from the other side offset laterally from the front finger and having an outer edge juxtaposed with the one side, the back fingers laterally flanking the front finger, a conductive core of another wire being pinched between the outer edge of the other back finger and the one side and bearing laterally against the other of the edges of the front finger.

10. In combination with a wire having a conductive core and a lamp having a contact pin, a lamp holder comprising:

a socket housing forming a seat centered on an axis; and a contact fitted to the seat and formed unitarily with a pair of opposite generally axially extending sides flanking the axis, a front finger extending generally axially from one of the sides and having a pair of opposite edges and therebetween a face directed radially toward the axis and pressing the lamp contact pin transversely of the axis against the other side, and a back finger extending from the other side offset laterally from the front finger and having an outer edge juxtaposed with the one side, the conductive core being pinched between the outer edge and the one side laterally adjacent the front finger and bearing laterally against one of the edges of the front finger, the pin and core axially overlapping each other.

* * * * *